US005971521A

United States Patent [19]

Bainvel et al.

[11] Patent Number: 5,971,521

[45] Date of Patent: Oct. 26, 1999

[54] RETRACTABLE CAPPING DEVICE FOR A FRANKING MODULE

[75] Inventors: Jean-Marc Bainvel, Boulogne Billancourt; Jean-Pierre Gregoire, Brie Comte Robert, both of France

[73] Assignee: Neopost Industrie, Bagneux, France

[21] Appl. No.: 08/781,194

[22] Filed: Jan. 10, 1997

[30] Foreign Application Priority Data

Jan. 10, 1996 [FR] France ..... 96 00199

[51] Int. Cl.[6] ..... B41J 2/165

[52] U.S. Cl. ..... 347/32; 347/29; 347/49

[58] Field of Search ..... 347/32, 49, 29

[56] References Cited

U.S. PATENT DOCUMENTS

| | | | |
|---|---|---|---|
| 4,371,881 | 2/1983 | Bork et al. | 347/29 |
| 5,097,276 | 3/1992 | Midorikawa | 347/32 |
| 5,455,609 | 10/1995 | Gast et al. | 347/32 |
| 5,467,709 | 11/1995 | Salomon | 101/93 |
| 5,579,039 | 11/1996 | Kurata et al. | 347/49 |

FOREIGN PATENT DOCUMENTS

| | | |
|---|---|---|
| 04 16 849 A2 | 3/1991 | European Pat. Off. . |
| 05 27 504 A1 | 2/1993 | European Pat. Off. . |

*Primary Examiner*—Valerie Lund
*Assistant Examiner*—Christina Annick
*Attorney, Agent, or Firm*—Sughrue, Mion, Zinn, Macpeak & Seas, PLLC

[57] ABSTRACT

A device for capping at least one ejection nozzle of a removable ink jet print head of a postage meter, the device including protection means for protecting the ink contained in the nozzle against drying out, the device protection means being mounted on support means capable of moving between a first position in which the protection means are retracted inside the print head and a second position in which the protection means cover the ejection nozzle(s) completely, said displacement being performed automatically while said head is being extracted from a base of a postage meter in which it is incorporated.

The support means are U-shaped, having two parallel arms interconnected at one end by a link element receiving said protection means, and wherein they are capable of pivoting about a common axis secured to a frame of the device.

8 Claims, 7 Drawing Sheets

RETRACTABLE CAPPING DEVICE FOR A FRANKING MODULE

FIELD OF THE INVENTION

The present invention relates to a capping device for a removable ink-jet print head of a postage meter or "franking machine".

PRIOR ART

In the field of postage meters, ink-jet technology raises the critical problem of protecting the print head, or more precisely its print module, i.e. the ejection nozzles of the head, whenever the head is separated from the base of the postage meter for the purpose of being refilled with monetary value. Without special protection, the nozzles are subjected to the air and to pollution while the head is withdrawn, and that has the consequence of causing the ink contained in the print module to dry and become contaminated with dust particles.

OBJECT AND BRIEF SUMMARY OF THE INVENTION

An object of the invention is thus to propose a capping device that mitigates the above-mentioned drawbacks by avoiding drying or contamination of the ink while the print head of a postage meter is being separated and transported. Another object is to provide a device that facilitates subsequent cleaning of the print module, particularly when reinstalling the head.

Thus, the present invention provides a device for capping at least one ejection nozzle of a removable ink jet print head of a postage meter, the device including protection means for protecting the ink contained in the nozzle against drying out, wherein said protection means are mounted on support means capable of moving between a first position in which the protection means are retracted inside the print head and a second position in which the protection means cover the ejection nozzle(s) completely.

The capping device is thus fully integrated in the print head which can be transported without any risk of polluting the ejection nozzles. The protection obtained in this way can he further enhanced by the protection means including an elastomer gasket to guarantee good sealing of the nozzles against air and dust.

The support means are moved from said first position to said second position automatically while the head is being extracted from the base of the postage meter in which it is incorporated. No external tool or special means is required to protect the nozzles. Also the nozzles are made easier to clean during re-installation of the print head.

Advantageously, said support means are U-shaped, having two parallel arms interconnected at one end by a link element receiving said protection means, and the is support means are capable of pivoting about a common axis secured to a frame of the device. Pivoting of the U-shape is facilitated by the fact that each of the arms is guided along at least one track by at least one stud secured to the frame of the device.

Preferably, the track has a profile that is sickle-shaped with a curvilinear portion and a rectilinear portion, such that the support means can describe in succession a curvilinear path during a stage in which the protection means are brought parallel to the faces of the ejection nozzles, and are then moved along a rectilinear path during a following stage in which the nozzles are covered.

Also, each of the arms further includes a respective wheel capable of moving in a track of a cam that can be rotated about an axis by a control device acting against a spring fixed to a body of the print head. Preferably, the control device includes a lever which is actuated automatically while the print head is being extracted from the postage meter.

The support means further include a plate constituting a deflector for articles of mail inserted beneath the print head when said support means is in said first position.

The present invention also provides any removable ink jet print head for a postage meter that includes a capping device as described above for at least one ejection nozzle.

BRIEF DESCRIPTION OF THE DRAWINGS

Other characteristics and advantages of the present invention appear further from the following description given by way of non-limiting indication and with reference to the accompanying drawings, in which.

DETAILED DESCRIPTION OF A PREFERRED EMBODIMENT

Figure 1A:
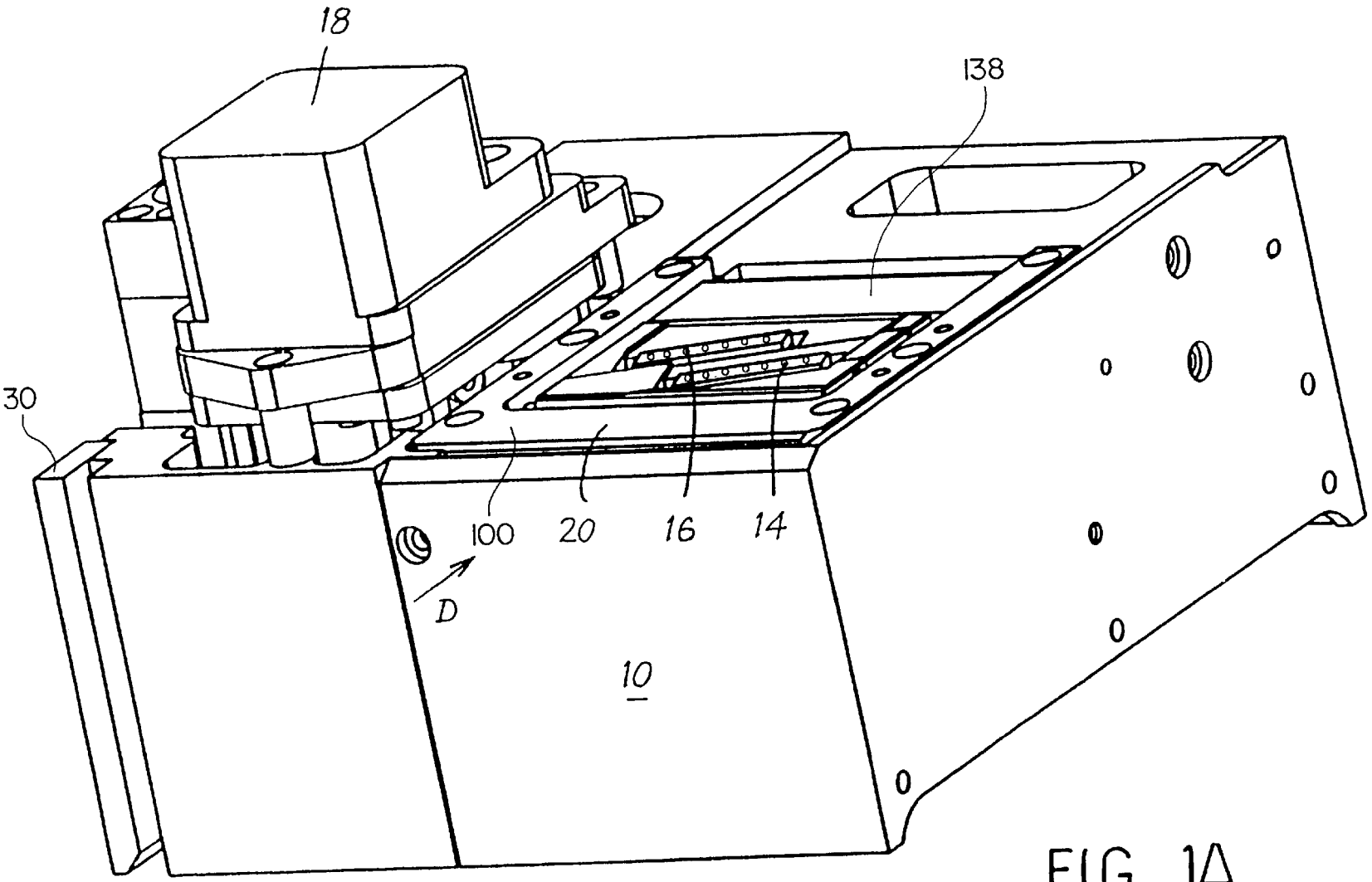
FIG. 1A is a perspective view of a postage meter print head incorporating a capping device of the invention, prior to the head being withdrawn
Figure 1B:
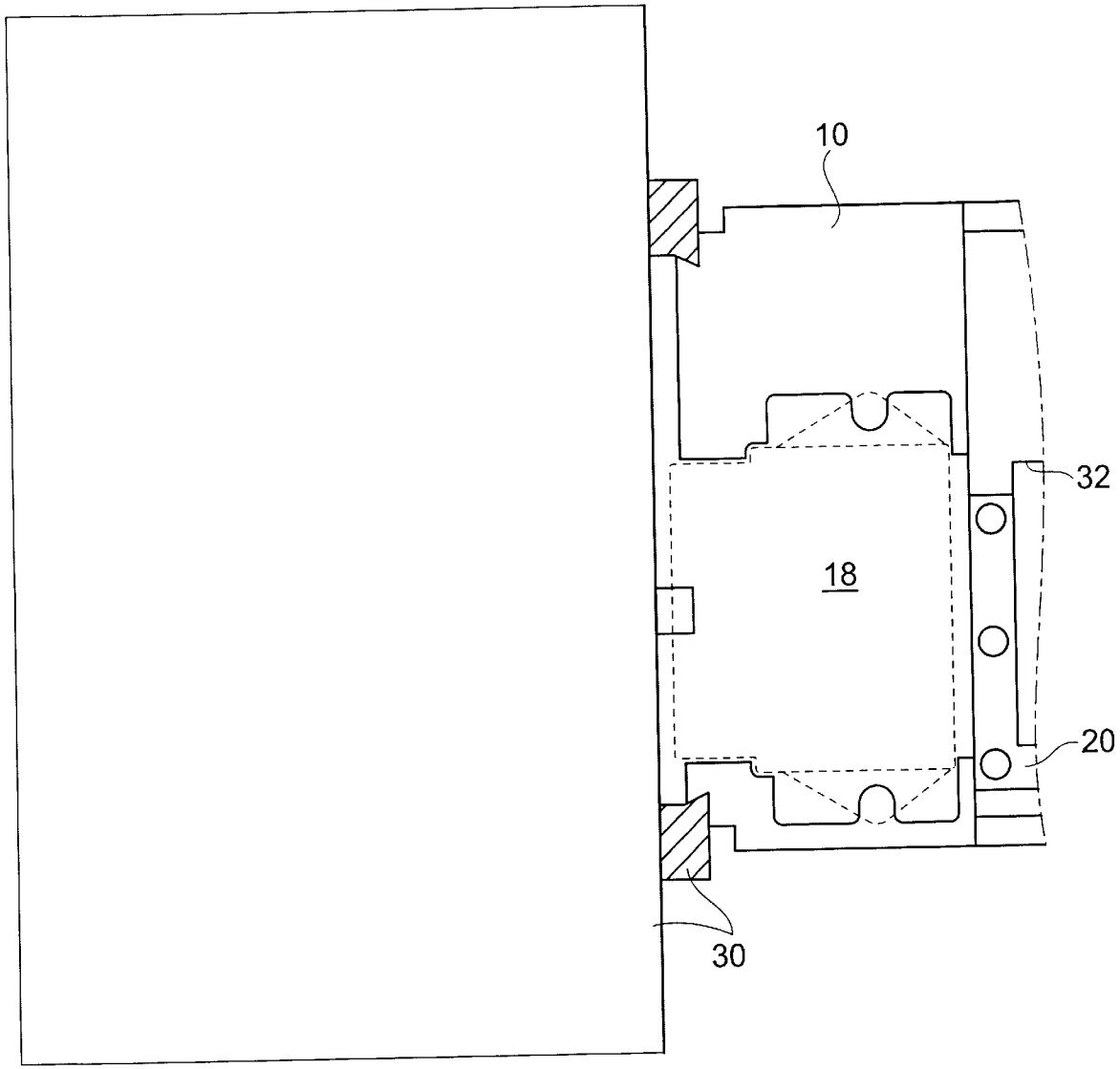
FIG. 1B is a related plan view.
Figure 2:
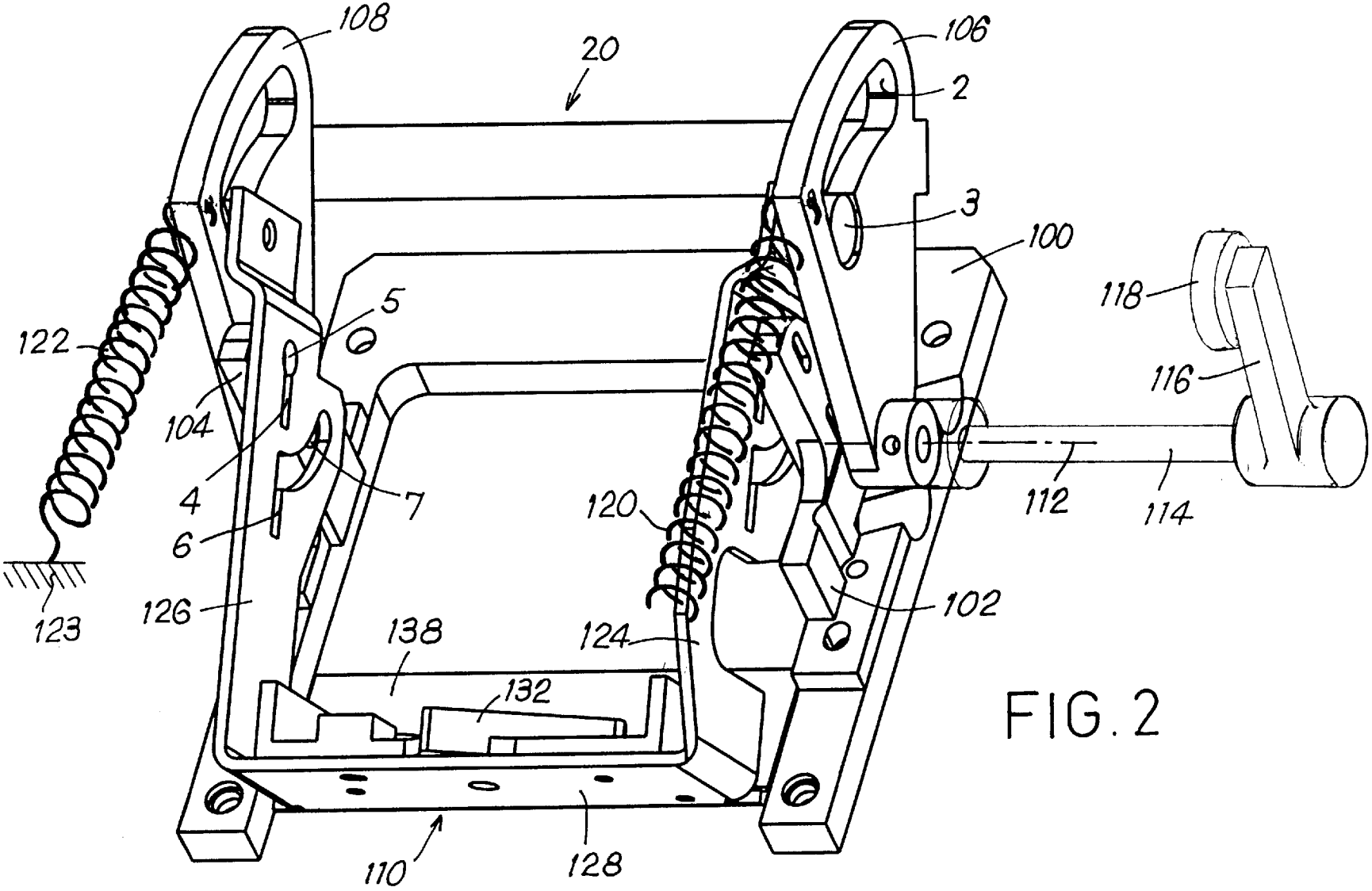
FIG. 2 is a perspective view of the capping device in an initial position prior to the head being withdrawn.

FIG. 1 shows a postage meter print head 10 in the form of at least one ink-jet print module 12, e.g. constituted by two staggered parallel rows 14, 16 of ejection nozzles together with an integral reservoir 18, and secondly by a capping device 20 of the invention for co-operating with the ink-jet print module 12 over which an article of mail moves in a displacement direction D. FIG. 2 shows in greater detail the capping device which is shown in FIG. 1 while in an initial retracted position prior to the print head being withdrawn from the base 30 of the postage meter.

The capping device 20 comprises a frame 100 constituted very simply by two parallel bars inter-connected at one end by a cross-member. The outside face of the frame faces the article of mail and defines a travel surface for conveying such articles, while the inside face of the frame has two lugs 102, 104 each mounted on a respective one of its bars and designed to receive firstly respective tracked cams 106, 108 (each in the form of a sector) that are secured to each other, and secondly U-shaped support means 110. The cams 106 and 108 are mounted on the outsides of the lugs to pivot about a common axis 112, and each cam has a respective camming track 2 having a curvilinear portion 2*a* and a substantially rectilinear portion 2*b*, the tracks co-operating with respective wheels 3 secured to the U-shape 110. In the embodiment shown, the tracks 2 are in the form of through slots, but they could equally well be in the form of other camming surfaces such as grooves or ridges. The common axis of the cams is connected to a control device constituted by a shaft 114 having a lever 116 fixed to the end thereof to be actuated automatically during print-head extraction, e.g. by means of a wheel 118 mounted on the lever and moving over a ramp (not shown) on the base of the postage meter. Each of the cams is also connected to the body 123 of the print head by a respective resilient return element such as a coil spring 120 or 122.

The U-shape support means 110 is mounted inside the support lugs and is formed by two parallel arms 124 and 126 inter-connected by a perpendicular link element 128 constituting a floor and having at least one protection means such as a cap 132, 134 on its inside face 130, and suitable for completely covering the row(s) 14, 16 of print-head ejection nozzles. Also, an elastomer gasket 136 is advantageously placed in each cap to guarantee that the nozzles are sealed against air and dust. The U-shape support means also has a plate 138 fixed to its link element and extending between its two arms at an orientation relative to the plane defined by said link element such as to enable the plate in the initial position to form a deflector on a portion of the outside face of the frame 100 for the purpose of deflecting articles of mail and thus preventing them from penetrating into the device. Each arm of the U-shape support means has two camming tracks 4, 6 co-operating with two studs 5, 7 secured to the corresponding lug supporting the arm, with one of the studs (referenced 5) defining a common axis of rotation about which the U-shape can pivot. In this embodiment, both tracks in each arm is in the form of a slot. One of the two tracks is sickle-shaped having a curvilinear first portion 6a and a rectilinear second portion 6*b*, while the other track 4 is essentially rectilinear 4*b*, while nevertheless accompanied by a circular portion 4*a* to facilitate rotation about the stud 5.

Figure 3:
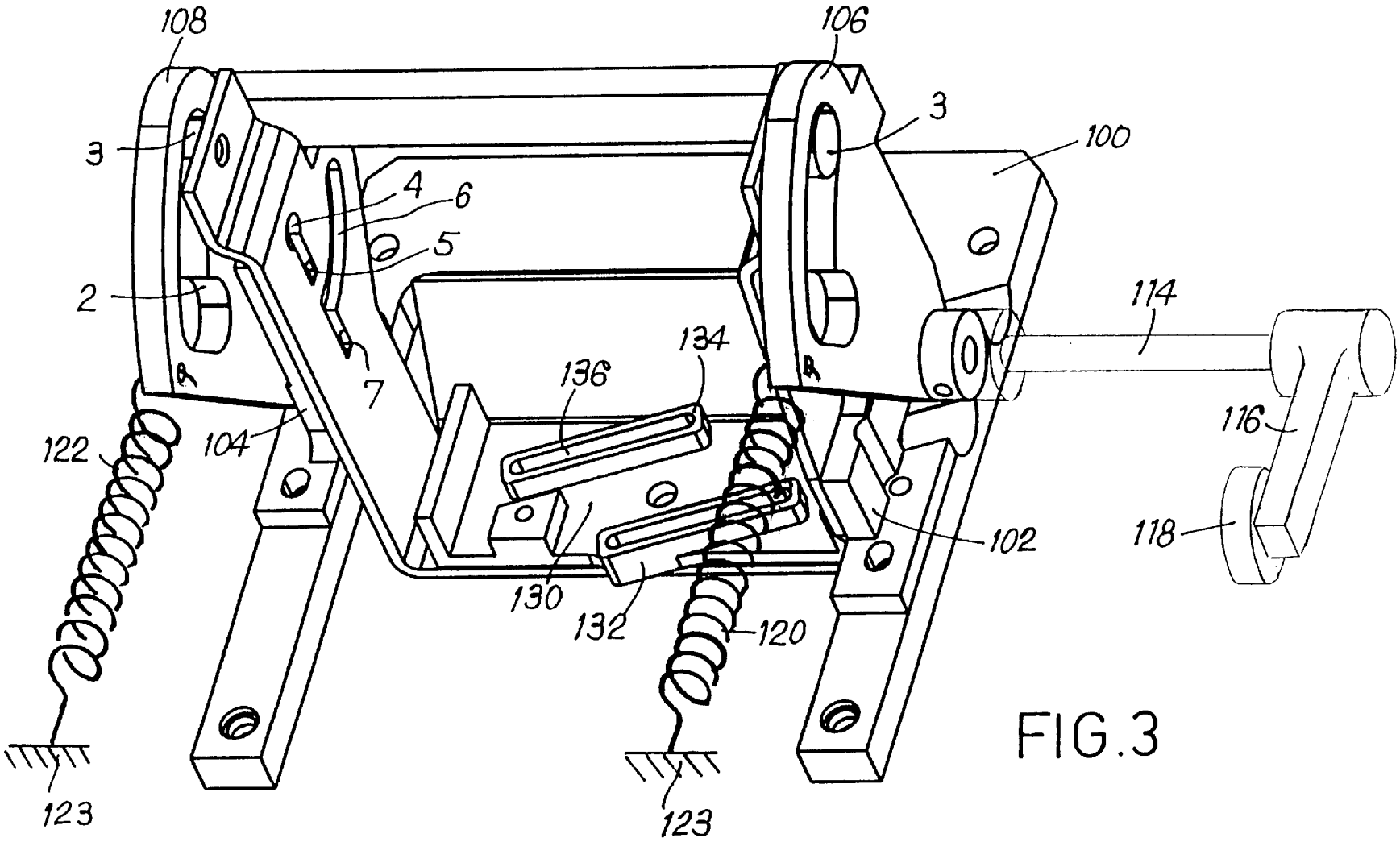
FIG. 3 is a perspective view of the capping device in a final position after the head has been withdrawn.

FIG. 3 shows the same capping device in a final position after the head has been withdrawn. The elements described above can still be seen, but some of them are in different positions. This applies to the cams 106 and 108 and to the U-shape 110, each of which has pivoted about its respective axis driven by rotation of the lever 116. It will be observed that instead of the plate 138, it is now the floor 128 which lies in a plane parallel to the outside face of the frame 100 (and thus to the ejection faces of the nozzles) the plate being moved inside the print head in a slot 32.

Figure 4:
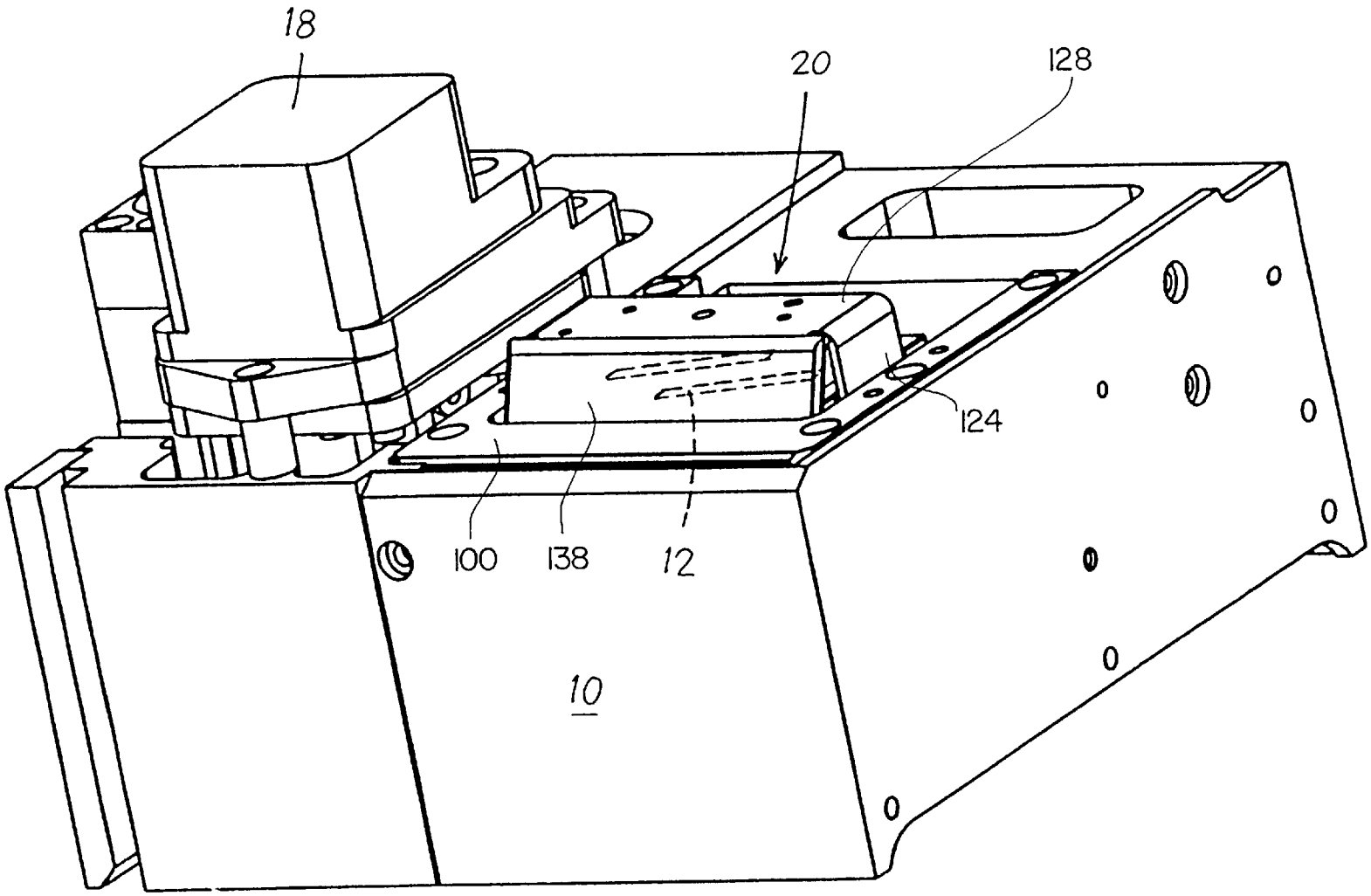
FIG. 4 is another perspective view of the FIG. 1 print head incorporating the capping device of the invention, but after said head has been withdrawn from the base of the postage meter.
Figure 5:
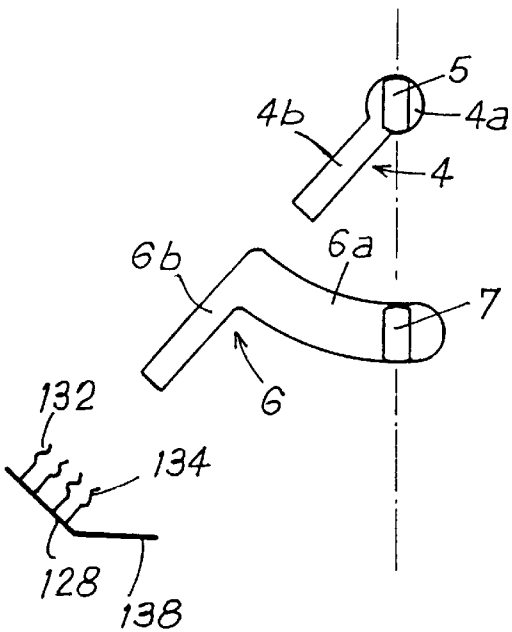
FIGS. 5 to 8 are diagrams showing four successive positions of co-operation between a first wheel and a camming surface of the capping device while said device is moving from its initial position to its final position.
Figure 6:
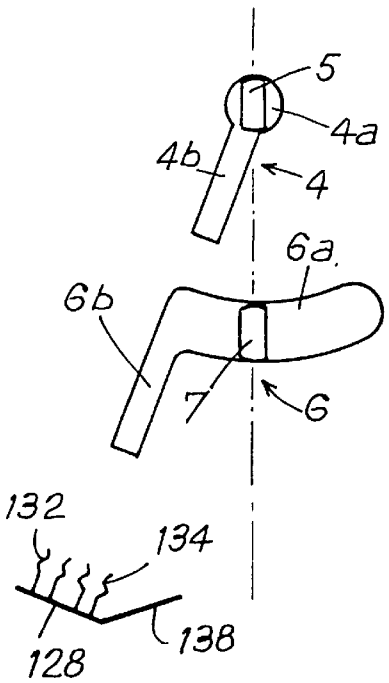
Figure 7:
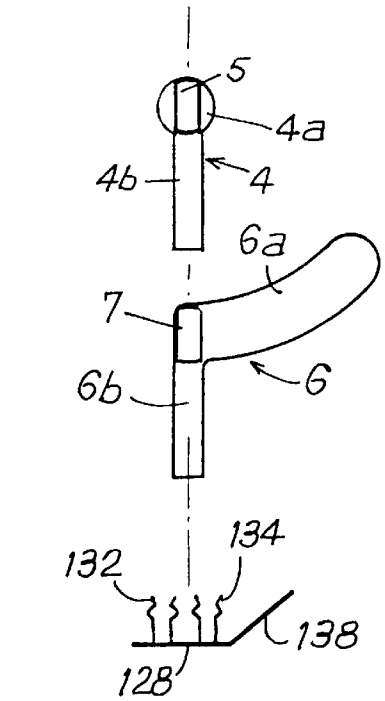
Figure 8:
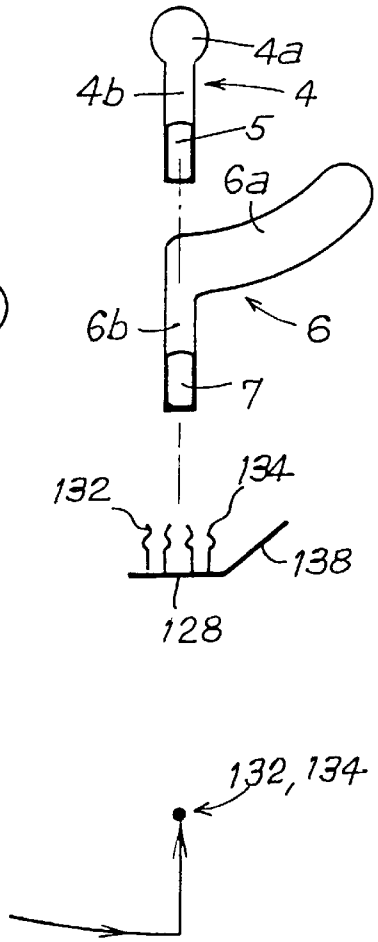

The capping device integrated in the print head 10 is shown in its final position in FIG. 4. In comparison with FIG. 1, it can be seen that the ejection nozzles are protected by the U-shape support means 110 whose protection means 132, 134 are in position against the ejection surfaces of the nozzles, thereby covering them completely. The head can then be moved very simply without any risk of causing the ink contained in the nozzles to dry out.

The operation of the device is described in greater detail below with reference to FIGS. 5 to 12 which show the respective positions of the wheels 3 and of the studs 5, 7 within the corresponding tracks 2; 4, 6 of the cams 106, 108 and of the arms 124, 126 of the device.

Figure 9:
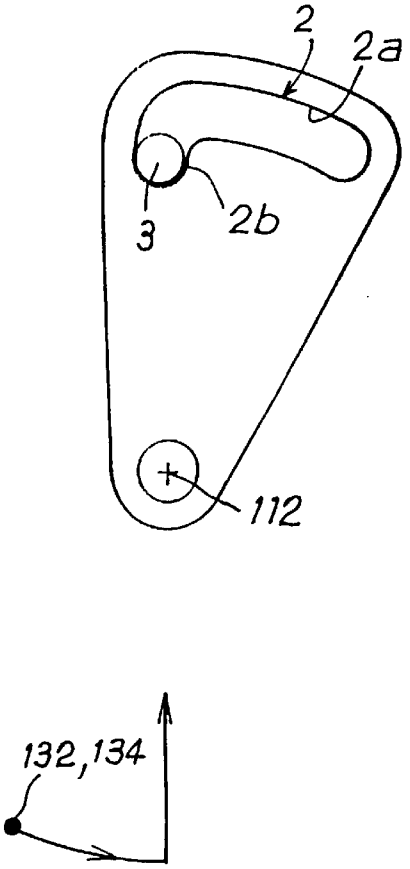
FIGS. 9 to 12 are diagrams showing co-operation between a second wheel and an associated camming surface for the same four predefined positions.
Figure 10:
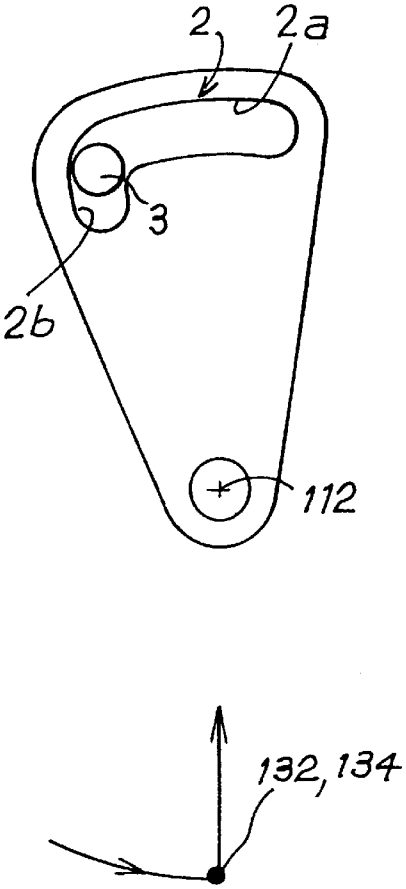
Figure 11:
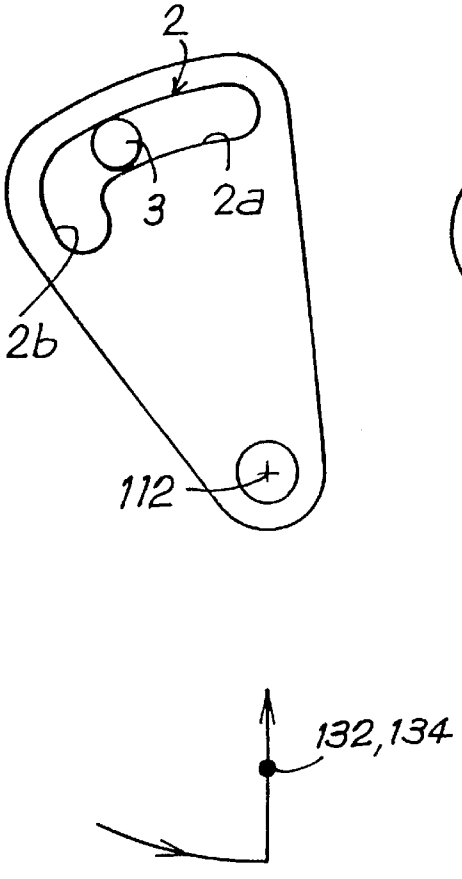
Figure 12:
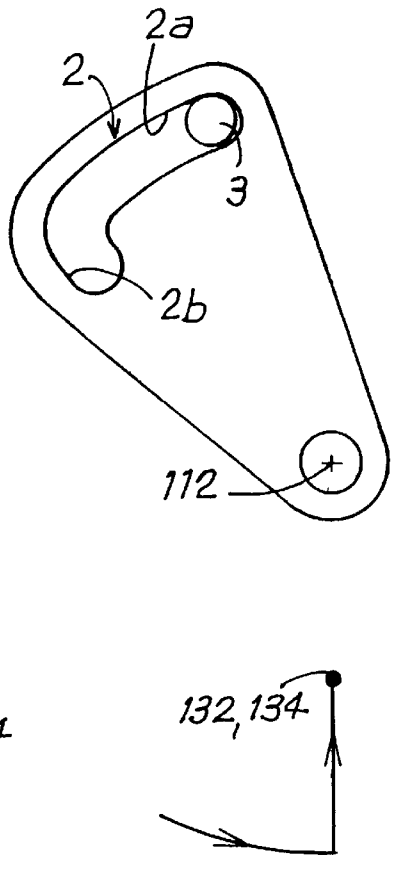

When the print head is extracted from the postage meter, it begins by causing the wheel 118 to rotate the lever 116 against the springs 120, 122 in the direction referenced F in FIGS. 2 and 3. This rotation driven by the shaft 114 in turn rotates the cams 106 and 108, and then the U-shape 110 support means which is guided along a curvilinear path in direction G by the studs 5 and 7 moving along the curvilinear portions of the tracks 4, 6 until the plate 138 is in position parallel to the ejection faces of the nozzles (observe in FIGS. 5 to 7 how the positions of the tracks 4, 6 of the arms vary relative to the corresponding studs 5, 7 as the U-shape moves). Similarly, FIGS. 9 and 10 show the displacement of the wheel 3 along its track 2 during this initial stage of bringing the protection means into position parallel to the faces of the ejection nozzles. Once contact between the wheel 116 and its ramp is interrupted, the springs 120 and 124 act on the came 106 and 108 during a second, or nozzle-covering, stage to cause the wheels to move along the curvilinear portions 2*a* of the tracks 2 of the cams, as shown in FIGS. 11 and 12, thereby causing the U-shape to be moved linearly, guided along the rectilinear portions of the tracks 4, 6 by the studs 5, 7, so as to be pressed against the rows 14, 16 of nozzles (see FIG. 8).

While the print head 10 is being put back into position on the base of the postage meter, the process whereby the protection means 132, 134 are put into place by the U-shape 110 support means takes place in reverse allowing the U-shape support means (including the floor 128 and plate 138) to return to its initial location inside the head in the position it occupied immediately before extraction, as shown in FIGS. 1 and 2.

We claim:

1. A postage meter having a base (30) and a removable ink jet print head (10) comprising:

at least one row of ejection nozzles (14, 16);

capping device (20) including a movable protection means (132,134) for covering said at least on row of ejection nozzles and a pivotable support means (110) for receiving said protection means and which moves between a first position in which said protection means is retracted in a slot (32) inside said ink jet print head and a second position in which said protection means covers said at least one row of ejection nozzles.

2. A postage meter according to claim 1, wherein said support means is U-shaped, having two parallel arms interconnected at one end by a link element receiving said protection means, and wherein said parallel arms are rotatable about a common axis associated with a frame secured to said base.

3. A postage meter according to claim 1, wherein each of said arms has at least one track and wherein said frame has studs extending therefrom which are individually received in each said track.

4. A capping device according to claim 3, wherein said track has a profile that is sickle-shaped with a curvilinear portion and a rectilinear portion, such that the support means defines in succession a curvilinear path during a stage in which the protection means are brought parallel to the faces of the ejection nozzles, and are then moved along a rectilinear path during a following stage in which the nozzles are covered.

5. A postage meter according to claim 2, wherein each of said arms further includes a respective wheel and said device further comprises a control device connected to said support means for rotating said support means in response to movement of said respective wheel.

6. A postage meter according to claim 5, wherein said control device includes a lever which is actuated automatically while the print head is being extracted from the postage meter.

7. A postage meter according to claim 2, wherein said support means further include a plate constituting a deflector for articles of mail inserted beneath the print head when said support means is in said first position, said plate extending between said arms.

8. A postage meter according to claim 1, wherein said protection means includes an elastomer gasket to guarantee that the ejection nozzles are sealed against air and dust.

* * * * *